US005767461A

United States Patent [19]

Nakagawa et al.

[11] Patent Number: 5,767,461

[45] Date of Patent: Jun. 16, 1998

[54] ELEVATOR GROUP SUPERVISORY CONTROL SYSTEM

[75] Inventors: Masami Nakagawa; Kenji Sasaki; Sandor Markon; Ichiro Nagashima; Takeshi Midoritani; Tomoaki Tanabe; Naoki Ohta, all of Osaka, Japan

[73] Assignee: Fujitec Co., Ltd., Osaka, Japan

[21] Appl. No.: 576,937

[22] Filed: Dec. 22, 1995

[30] Foreign Application Priority Data

| | | | |
|---|---|---|---|
| Feb. 16, 1995 | [JP] | Japan | 7-053383 |
| Mar. 10, 1995 | [JP] | Japan | 7-079592 |
| May 18, 1995 | [JP] | Japan | 7-145539 |

[51] Int. Cl.[6] ..... B66B 1/18

[52] U.S. Cl. ..... 187/382; 187/380; 187/247

[58] Field of Search ..... 187/380, 382, 187/387, 247

[56] References Cited

U.S. PATENT DOCUMENTS

| | | | |
|---|---|---|---|
| 5,250,766 | 10/1993 | Hikitta et al. | 187/133 |
| 5,306,878 | 4/1994 | Kubo | 187/127 |
| 5,354,957 | 10/1994 | Robertson | 187/247 |
| 5,544,059 | 8/1996 | Hikita et al. | 364/436 |

FOREIGN PATENT DOCUMENTS

| | | | |
|---|---|---|---|
| 01275381A | 11/1989 | Japan | B66B 1/18 |
| 03031173A | 2/1991 | Japan . | |
| 07069543A | 3/1995 | Japan . | |

*Primary Examiner*—Robert Nappi

*Attorney, Agent, or Firm*—Jordan and Hamburg

[57] ABSTRACT

An elevator group supervisory control system for selecting the most suitable car among a plurality of elevators, when a hall call is made, to assign to the hall call, comprising: temporary assigning means for temporarily assigning the car by a conventional method such as a fuzzy group supervisory control based on group data representing states of the elevator system at the moment when a new hall call is made; and a neural net for receiving numerical values converted from group data including the result of judgment of the temporary assigning means and outputting an assignment fitness of each elevator. It decides the most suitable elevator from the output pattern of the neural net to assign to the hall call.

8 Claims, 11 Drawing Sheets

ELEVATOR GROUP SUPERVISORY CONTROL SYSTEM

BACKGROUND OF THE INVENTION

The present invention relates to a structure and a construction method of an elevator group supervisory control system using neural networks.

Systems for controlling an elevator group applying fuzzy control (hereinafter referred to as a fuzzy group supervisory control system) have been increasing in recent years, and an explanation thereof will be made at first. When a passenger arrives at each elevator hall and registers an elevator call at the hall (hereinafter referred to as a hall call), the elevator group supervisory control system makes a judgment to select the most suitable elevator at that moment to allocate to the call. However, control objectives required for the elevator group supervisory control contain much variety, uncertainty and non-linearity as described below.

For example, the control is varied by the following objectives:

- Minimize the occurrence of long waits, during which passengers wait for an elevator over one minute;
- Minimize the average waiting time of all passengers;
- Equalize boarding rates of cars as much as possible;
- Minimize the average service time provided to all passengers (a total time spent by passengers until getting off cars after arriving at the elevator hall);
- Reduce flight time and the number of starts of elevators, to decrease energy consumption and wear;
- Maximize the handling capacity of the entire group during heavy traffic;
- Predict the car which arrives first, when real-time prediction is implemented; and so on.

Some of the above-mentioned objectives conflict with each other and an attempt to improve one side will worsen the other, for example:

- Energy Consumption vs. Waiting Time, and
- Elevator Boarding Rate vs. Waiting Time.

A simple control rule which balances such two objectives may not be necessarily found.

As for the uncertainties, there are the following factors:

- When and at which floor new hall calls are registered;
- Destination of passengers who are now waiting or who will wait at the hall; and so on. These factors will be obstacles in predicting how long it will take for elevators to arrive at each stop.

As for the non-linearity, the following events may arise:

- A combination of assignments to hall calls with least waiting times, when considered in a short time scale, is apparently different from that considered in a longer time scale; and the combination of assignments with the least waiting times changes discontinuously if the time scale is changed;
- In certain cases, full-load bypass may occur as the elevator transport capacity reaches the saturation point; and
- Elevators frequently reverse their traveling direction at intermediate floors, changing the arrival time of the elevator at a stop instantly and considerably.

Further, there are the following disturbances:

- Passengers may register wrong hall and/or car calls, causing unnecessary car stops; and
- Passengers may hold doors open unnecessarily, thus delaying the car movement.

It is therefore very difficult to improve the performance of a group of elevators having the above- mentioned characteristics just by means of classical linear control methods or an evaluation function method which is an improved version thereof. Therefore, fuzzy group supervisory control systems have been developed, by incorporating a fuzzy control, which allows various knowledge of experts to be reflected into this group supervisory control system to deal with the above-mentioned variety, uncertainty and non- linearity by correcting them by the knowledge of the experts. In the fuzzy group supervisory control system, fuzzy rules which describe knowledge and empirical rules of experts in a format of IF/THEN rules, is created in advance, values of evaluation indices such as a waiting time of a hall call is recognized as an amount of fuzzy from a membership function thereof and the most suitable car is selected and assigned from the adaptivity to the above-mentioned fuzzy rules. It enables the evaluation in selecting and assigning each car to each hall call to be compensated by the experts' experience and knowledge and the performance to be considerably improved as compared to the conventional evaluation function method.

Although the fuzzy group supervisory control system enables more sophisticated judgment than the conventional control, it has had a problem which is mainly caused by the fact that the fuzzy group supervisory control has had no "learning" ability in the true sense. The function conventionally called as "learning" has been merely the collection of statistical data and is not the learning in the sense of human beings, of obtaining new knowledge by learning from mistakes. Due to that, there has been the following problems:

- When an actual building is different from what an expert has assumed, the pre-incorporated rules do not always bring best results;
- The system performance is subject to expert skill;
- Tuning of the fuzzy membership functions is difficult and a large number of simulations needs to be carried out; and
- Once the rules have been incorporated, much time and effort would be necessary to modify them.

Accordingly, a new method called a Neuro Group Supervisory Control System for allocating calls by using neural networks (hereinafter referred to as a 'neural net') with self-learning capability has been developed recently, and an explanation thereof will be made briefly.

The neural net is modeled after the structure of brains of humans and animals. In a brain, a great number of neurons (nerve cells) are arranged like a net to exchange signals with one another. Each neuron is linked to adjacent neurons and knowledge is stored in the brain as the degree of intensity of linkage between neurons. It is believed generally, that as the brain functions, the linkage strength between neurons gradually changes. This change causes new knowledge or new memory to be stored in the brain.

A neuro-computer (a computer that implements a neural net) simulates such a mechanism in a computer to acquire knowledge basically in the same way as a brain.

When the neural net is used in the group supervisory control system, it brings about the desirable effect that the judgment system for deciding the most suitable car in response to various traffic situations will be automatically generated, requiring no assignment algorithm to be constructed by human beings. The cases in which the neural net is used in the assignment of elevators to calls have been disclosed in JP-A-01275381 under the title of "Elevator Group Advisory Control System", JP-A-0331173 under the title of "Elevator Group Advisory Control System" and JP-A-07069543 under the title of "Learning Method of Neural Net for Allocating Elevator Call" for example.

However, when the neuro group supervisory control system is designed to correct the shortcomings of the conventional fuzzy group supervisory control system and to improve its capabilities by incorporating the learning functions similar to the biological learning functions into the elevator group supervisory control system, the efficiency of the learning and the accuracy of assignment after the completion of the learning are affected significantly by what kind of data is selected as input signals to the neural net. That is, they are affected considerably by the selection of the data among various data necessary for call allocations and by the method how they are processed as input signals of the neural net.

In theory, any data which is associated with the call allocation is considered to usable as the input signals to the neural net. Therefore, not only direct data such as the position of a car and the running direction of each elevator, floors where calls have been made, the number of calls made, the state of load of the car and so on, but also various indirect data obtained by processing them, such as the predicted waiting time of hall calls used as an evaluation index in the assignment by means of the conventional evaluation function and the fuzzy group supervisory control systems and a worsened index value of waiting times of other hall calls caused when a new call is allocated, may be adopted as the input signals.

However, it has had a problem that if the number of input signals is increased too much, a number of neurons in an input layer of the neural net increases, thus complicating the connection thereof and requiring much time and effort not only in learning but also in finding which input signal is useful and which is less useful.

SUMMARY OF THE INVENTION

Accordingly, it is an object of the present invention to realize a group supervisory control most suited for each site by automatically creating a judgment system for deciding the most suitable car to be assigned in response to various traffic situations by utilizing the learning function of the neural net, requiring no explicit development of an assignment algorithm.

It is another object of the present invention to realize an advanced assignment control by including the result of judgment of AI (Artificial Intelligence) type group control such as the conventional fuzzy group supervisory control into the input patterns of the neural net.

An elevator group supervisory control system of the present invention comprises temporary assigning means for temporarily assigning a car by the conventional method such as the fuzzy group supervisory control and a neural net for receiving the result of judgment of the temporary assigning means together with other group data and outputting the level of eligibility for assignment of each elevator. When a hall call is made, the system temporarily assigns by the conventional method by using the various data (group data) indicating states of the elevator system at that moment and then inputs the result of judgment to the neural net together with other group data as input patterns. Then, it decides an elevator to be assigned from output patterns of the neural net obtained as a result.

While the neural net makes a judgment based on experiences obtained from learning, it can utilize an expert rule base in which knowledge of the designer is stored and can exhibit its full capacity even in a circumstance not experienced by the learning by including the result of judgment of the conventional AI type group supervisory control to the input data for judgment of the neural net like the present invention.

Further, by including the result of judgment of the conventional AI type group supervisory control, an effect equivalent to inputting a large number of useful indices used in the conventional assignment to the neural net is obtained, thus allowing not only highly accurate assignment to be realized but also a number of data used for the input pattern of the neural net to be minimized and the connections of the neural net are prevented from becoming too complicated.

The above and other related objects and features of the present invention will be apparent from a reading of the following description of the disclosure found in the accompanying drawings and the novelty thereof pointed out in the appended claims.

DETAILED DESCRIPTION OF PREFERRED EMBODIMENT

A preferred embodiment of the present invention will be explained below with reference to the drawings.

Figure 1:
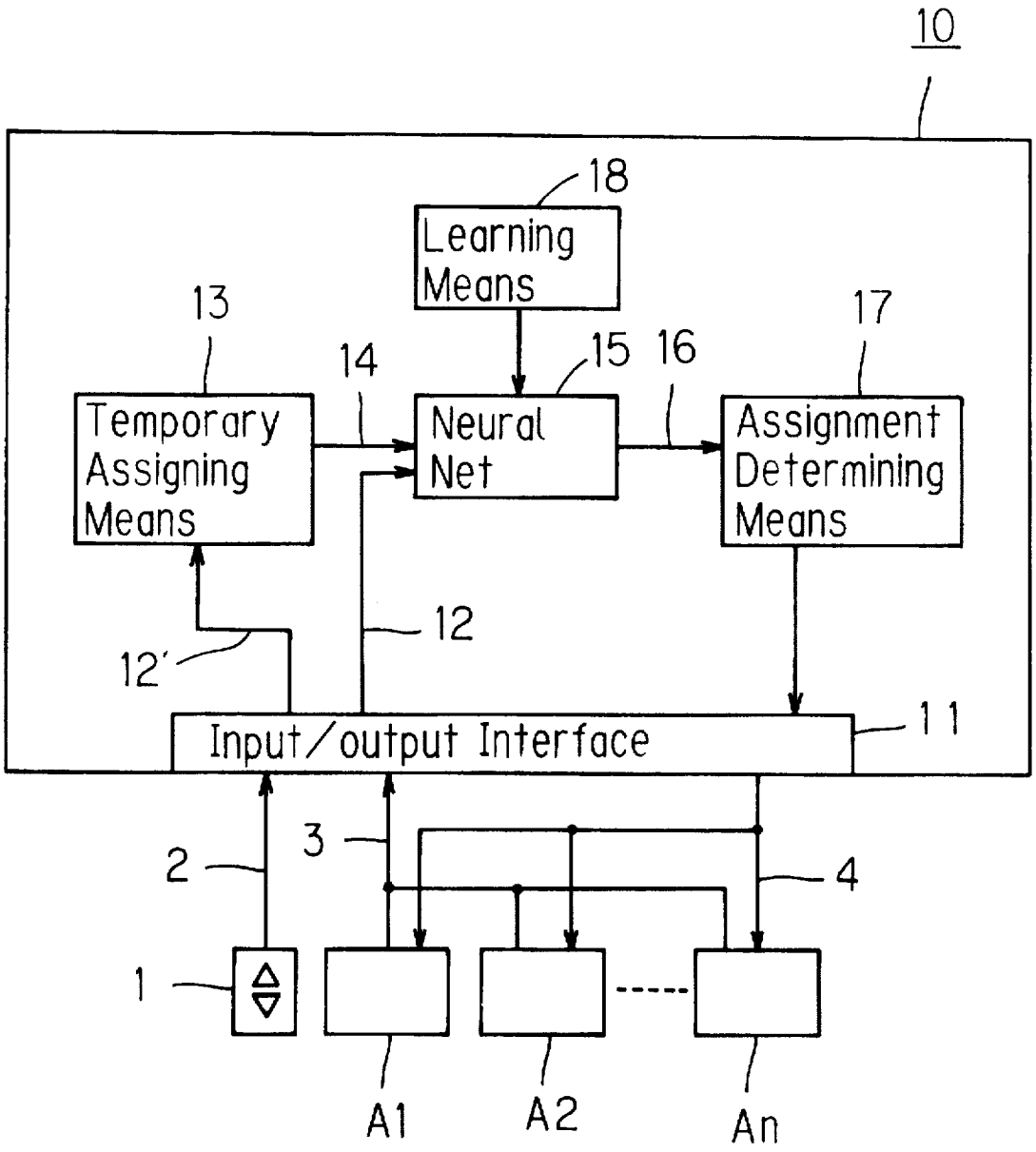
FIG. 1 is a block diagram illustrating a whole structure of the present invention.

FIG. 1 is a block diagram illustrating a whole structure of the present invention. In the figure, a hall call button 1 is provided at each floor (only a button for one floor is shown and those for other floors are omitted), a signal 2 represents a hall call, an operation controller A1 controls the operation of an elevator No. 1 and operation controllers A2 through An control the operation of elevators No. 2 through No. n, respectively. A car data signal 3 represents states of each elevator (such as position and running direction of the car, whether it is running or stopped, whether the door is opened/closed, car calls, a state of load, floors to which service is provided, the presence or absence of abnormal state and so on). A group supervisory controller 10 receives group data composed of the car data signal 3 and the hall call signal 2, allocates the hall call to the most suitable elevator and outputs it as an assignment signal 4. It is composed of a microcomputer and others and is equipped with a CPU, a ROM, a RAM, a memory and the like (not shown). Each of the operation controllers A1 through An controls the operation of each car so as to respond successively to the hall call assigned via the above-mentioned assignment signal 4 and to a car call registered within the car of the elevator.

The group supervisory controller 10 includes an input/output interface 11, elevator system state data (group data) 12 and 12' composed of the above-mentioned hall call signal 2 and the car data signal 3, etc. (type of each data of the signals 12 and 12' need not be always the same), temporary assigning means 13 for temporarily assigning an elevator by the conventional method such as the fuzzy group supervisory control based on the group data 12' and, a signal 14 representing the temporary assignment, a neural net 15 for assignment for receiving the result of the temporary assignment together with the group data 12 as input patterns and outputs an assignment aptitude 16 of each elevator as an output pattern, assignment determining means 17 for determining an elevator to be assigned from the assignment aptitude 16, and learning means 18 for implementing learning of the neural net 15. It is noted that each of these means and the neural net are realized on software of the microcomputer.

Figure 2:
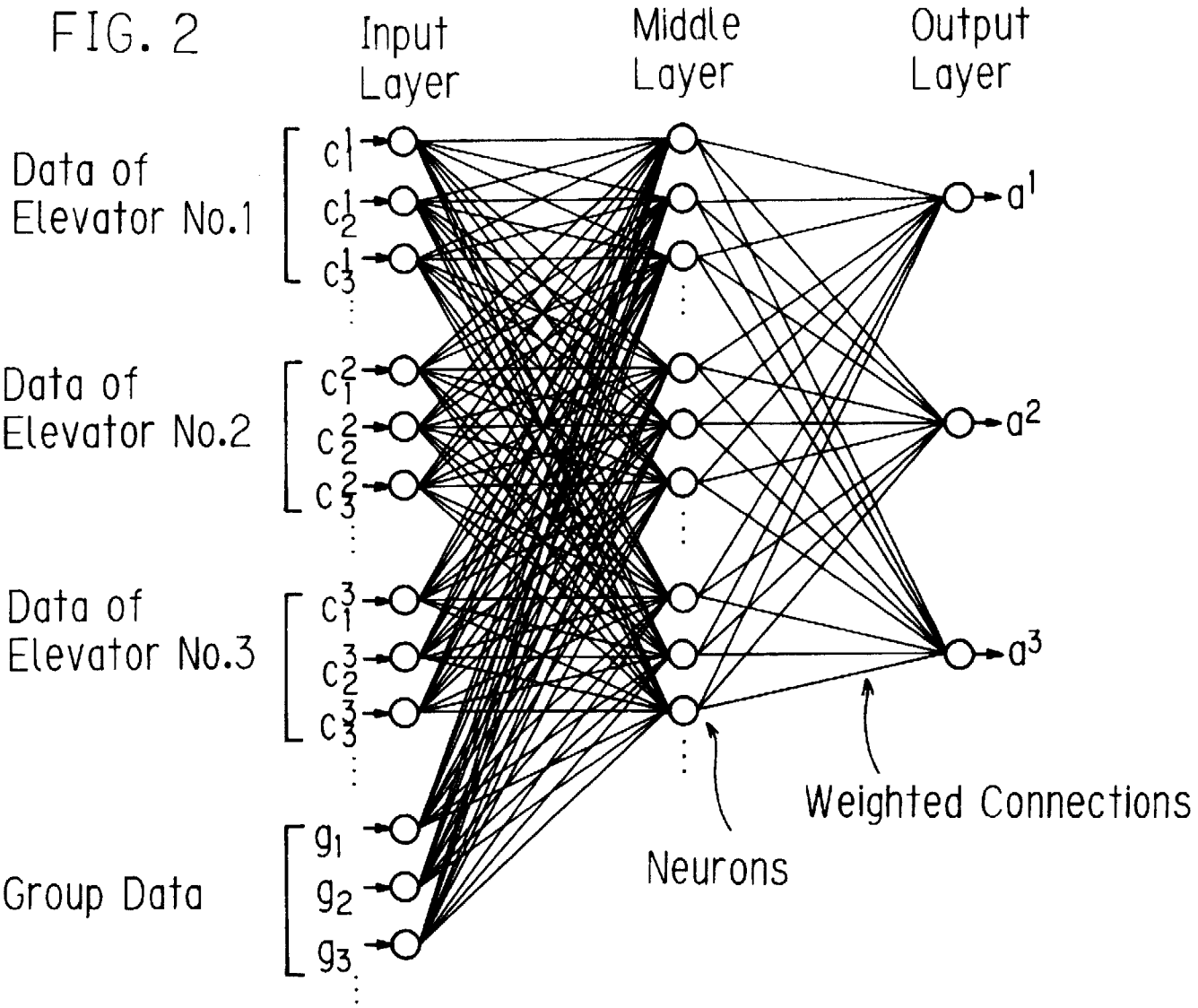
FIG. 2 is a diagram showing one example of a structure of a neural net for assignment.

FIG. 2 shows one example of a structure of the neural net for assignment. In this example, the neural net is composed of neurons of three layers of an input layer which corresponds to the input pattern (system state data), an output layer which corresponds to the output pattern (assignment aptitude) and a middle layer (hidden layer) disposed therebetween.

The input pattern is the group data described above converted into numerical values, wherein $C_{1n}$, $C_{2n}$, $C_{3n}$ . . . represent group data concerning an elevator No. n (e.g. whether or not it is the temporarily assigned elevator by the fuzzy group supervisory control; the number of hall calls assigned for the section between the present car position and a floor where a hall call has been registered; the maximum waiting time of hall calls allocated to that car, etc.) and $g_1$, $g_2$, $g_3$, . . . represent group data common to each elevator (e.g. the number of hall calls registered at present; the number of hall calls registered in the past five minutes; the present distribution of cars; etc.). The number of neurons in the input layer corresponds to the total number of such data.

When the input signals are supplied to each of the neurons in the input layer, those signals propagate through the neural net corresponding to the degree of connection weight between neurons and assignment fitness (evaluation values) $a_1$, $a_2$ and $a_3$ ($a_n$ is the assignment fitness of an elevator No. n) are output from each of neurons in the output layer. The output layer has as many neurons as there are elevators. Learning of values of the connection weight between each neuron has been made in advance so that a neuron which corresponds to an elevator most suited to be assigned outputs "1" (or maximum value) and so that other neurons output "0" with respect to the various input patterns. This learning is performed as follows.

That is, a value of the connection weight (synapse weight) indicating a strength between each neuron is set at a small random value first and then it is modified by using a learning algorithm called "back-propagation" so that more accurate call allocation can be made. Since the back-propagation is well known, it will be explained below just briefly. It is an algorithm for modifying the connection weight by using a learning sample (a pair of an input pattern and an output pattern which is desirable for the input pattern, i.e. a teacher signal) created in advance. At first, all weights are initialized (e.g. set at random values) and then an input pattern of the learning sample is supplied to each neuron in the input layer. Then, a value of an actual output pattern at that time is compared with a value of the output pattern (teacher signal) in the learning sample and using the difference (error), the value of each connection weight is modified successively from the side of the output layer so that the difference is reduced.

When such operation is repeated by using a large number of learning samples until the error converges, a call assignment function equivalent to the teacher signal is embedded automatically in the neural net and it becomes possible to allocate calls in the same manner like the teacher signal, not only to the input patterns used for learning but also to unknown input patterns.

Accordingly, after completing this learning, a neuron which outputs a value closest to "1" (or maximum value) among values of each neuron of the output pattern indicates that it is the most suitable for the assignment and an elevator which corresponds to that neuron is selected as an elevator to be assigned.

It is noted that a number of neurons in the middle layer (although one layer is shown in the embodiment, it may be two or more) is defined appropriately corresponding to a number of elevators and characteristics of a building. Empirically, it was found that the same or greater number of neurons like in the input layer is usually suitable.

Figure 3:
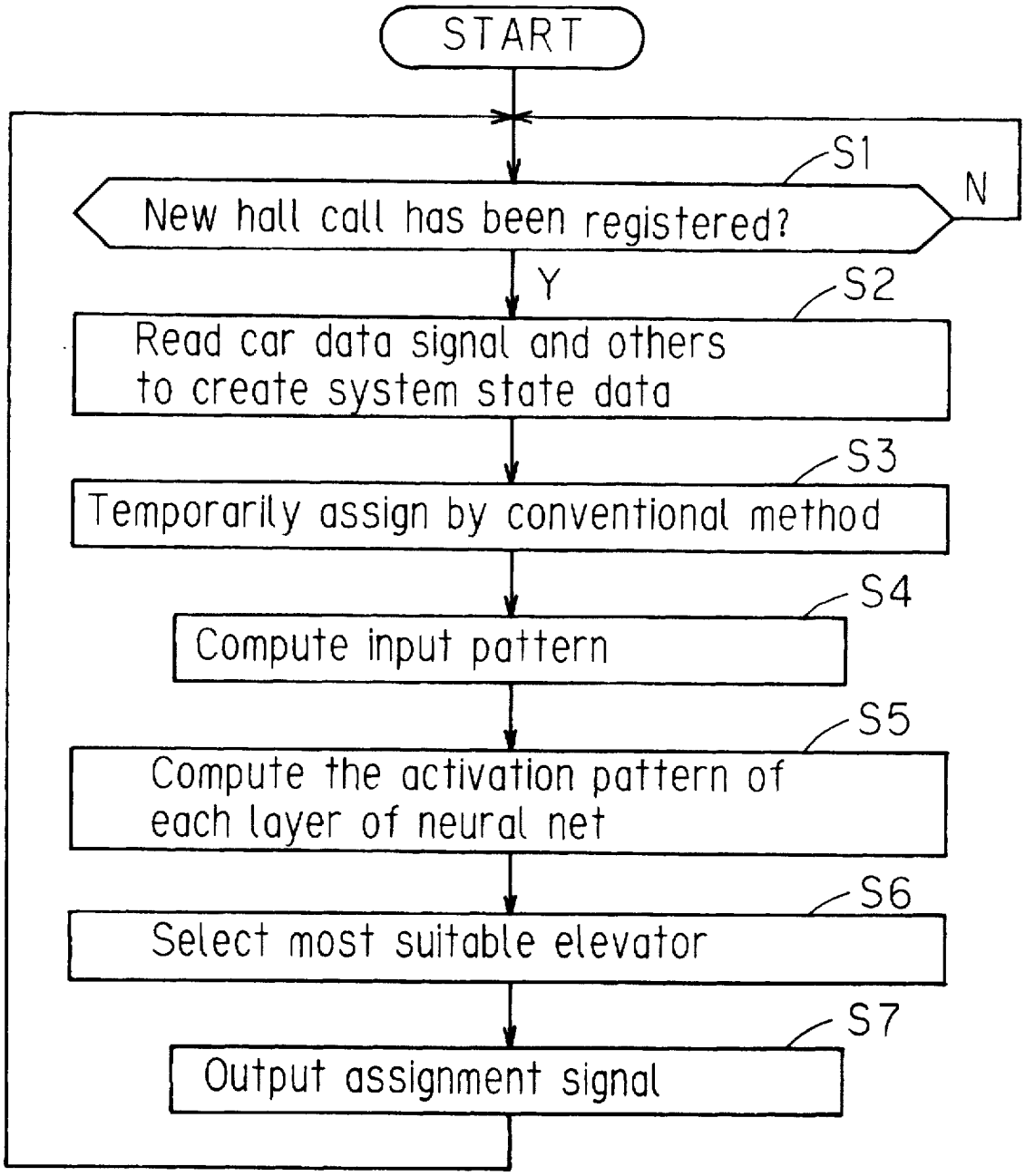
FIG. 3 is a flowchart showing an assignment procedure according to the present invention.

A procedure for assigning an elevator after the learning of the present invention will be explained based on a flowchart in FIG. 3.

First, it is determined in Step S1 whether a new hall call has been made or not. If it has been made, the hall call signal 2 and the car data signal 3 at that moment are read and the elevator group data 12 and 12' are created by adopting them or partly processing them in Step S2.

In Step S3, a temporary assignment is carried out by the conventional method, e.g. the fuzzy group supervisory control described before, based on the group data 12'.

The group data 12' may be "a predicted waiting time of a new hall call", "a maximum waiting time of a hall call at a floor in the same direction with the running direction of a car and beyond a floor where a new hall call has been made" or "worsening of waiting time of other hall call caused when a new hall call is allocated" which have been conventionally used, beside a position of a car of each elevator and floors where calls have been made.

In Step S4, data of the result of the temporary assignment of the temporary assigning means 13 and the group data 12 are converted into numerical values and are input to the neural net 15 as the input pattern. The group data 12 may be the same as the group data 12' or may be a part of the data cut to simplify the neural net.

Because the connection weight between each neuron of the neural net has been set in advance by the learning as described before, the output of each layer may be found successively by arithmetic operation when the input pattern is defined. This process is carried out in Step S5. An elevator which is considered to be most suitable is selected from the value of the output pattern in Step S6 and it is output as the assignment signal 4 in Step S7. The above- mentioned procedure is repeated thereafter to assign elevators successively every time when a hall call is made.

While it is necessary for the neural net to set the connection weight between each neuron by performing the initial learning in advance as described above, this initial learning is performed by creating learning samples while operating elevators by simulation or on-site, and by using those samples.

Figure 4:
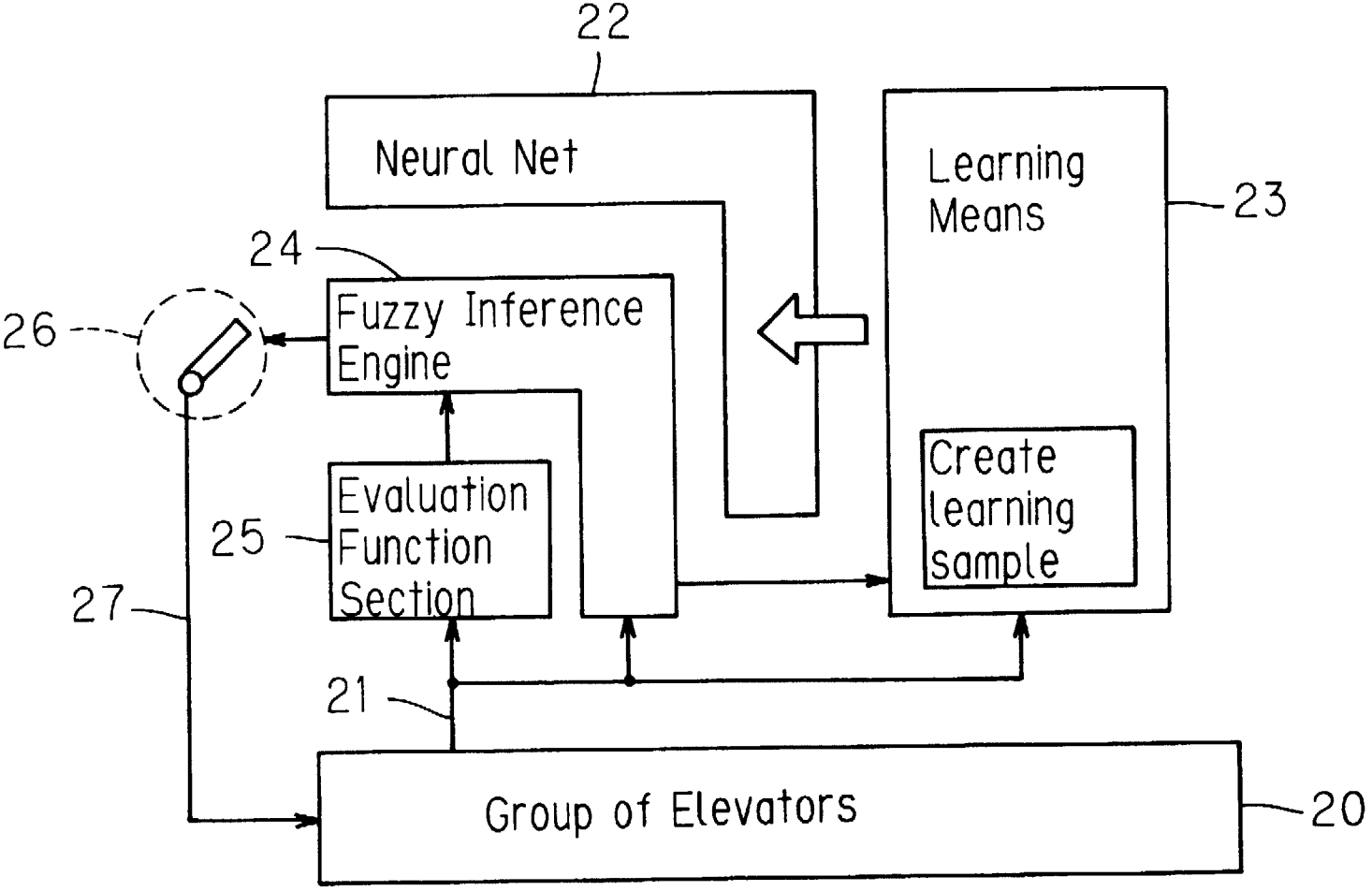
FIG. 4 is a block diagram illustrating a whole structure when a conventional fuzzy group supervisory control is used as assigning means during initial learning.
Figure 5:
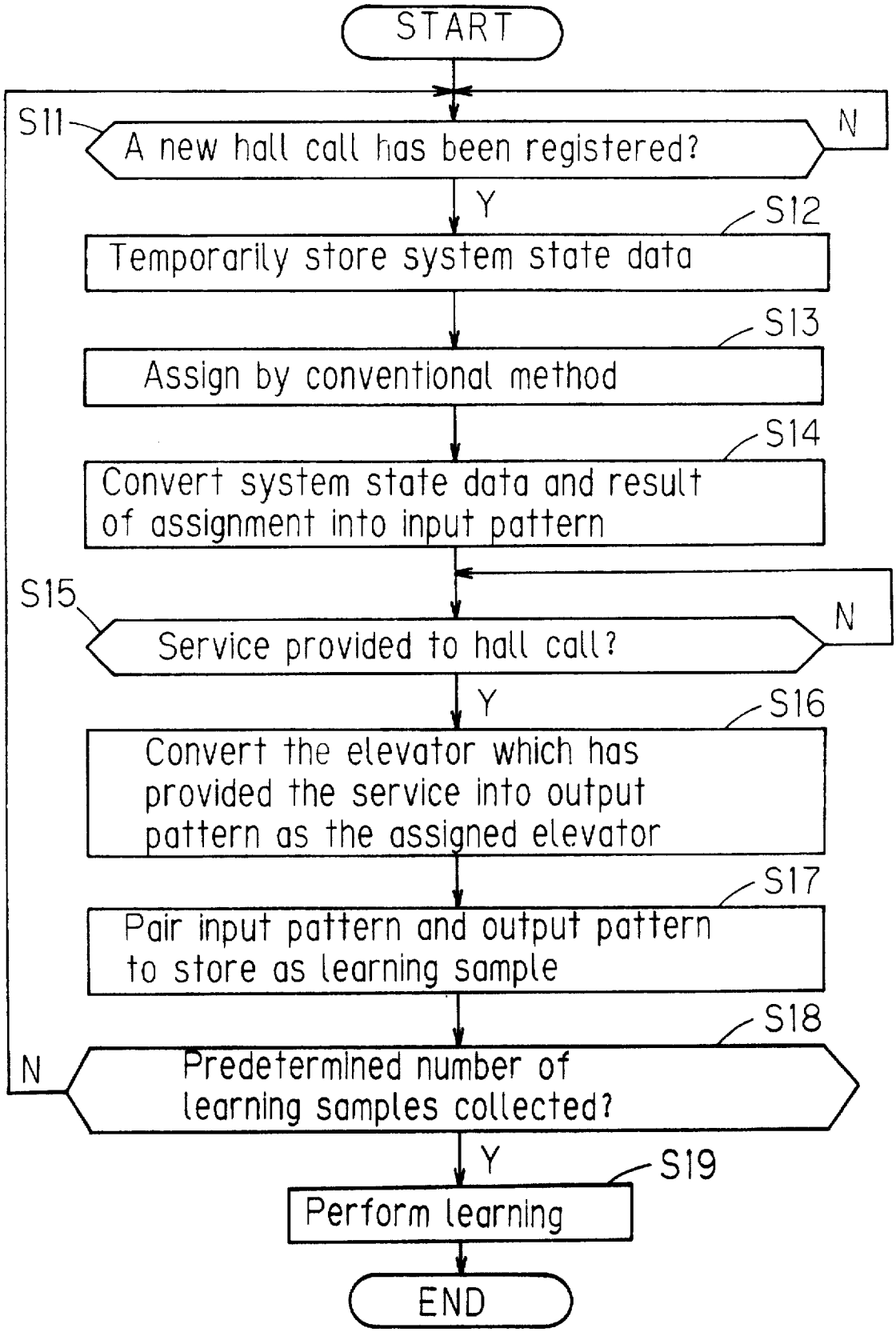
FIG. 5 is a flowchart showing a procedure of the initial learning.

FIG. 4 shows the whole structure of the system in performing the initial learning and FIG. 5 is a flowchart showing the learning procedure.

FIG. 4, which corresponds to FIG. 1, shows the system when the conventional fuzzy group supervisory control is used as the assigning means during the initial learning. In the figure, the system comprises a group of elevators 20, data of the group 21, a neural net 22 which is to perform the initial learning, learning means 23 for creating learning samples and implementing the learning of the neural net based on the learning samples, a fuzzy inference engine 24 for allocating hall calls by fuzzy inference, an evaluation function section 25 for performing arithmetic operation of evaluation indices necessary for the fuzzy inference based on the elevator group data, switching means 26 for switching between assignments by means of the fuzzy group supervisory control during the initial learning and by means of the neural net after completion of the initial learning, and an assignment signal 27.

The procedure for creating the learning samples and implementing the initial learning by the learning means 22 in the system constructed as described above will be explained with reference to the flowchart shown in FIG. 5.

First, it is determined in Step S11 whether a new hall call has been made or not and when it has been made, the elevator group data 21 at that moment is stored temporarily in Step S12.

In Step S13, this call is allocated by the fuzzy group supervisory control and the assignment signal 27 is output to the group of elevators. The data of result of this assignment and group data are converted into the input pattern of the neural net in Step S14.

It is then confirmed in Step S15 whether service has been provided to the call or not and an elevator which has actually provided the service is converted into the output pattern of the neural net as the elevator having the best assignment fitness.

For example, when the elevator No. 1 has provided the service to the call, an output pattern, in which a value of the neuron in the output layer which corresponds to the elevator No. 1 is set to "1" and values of other neurons in the output layer are set to "0", is created. By doing so, even when the elevator which had been initially assigned is different from what has actually provided the service due to a change in the assignment or a re-assignment, i.e. when the initial assignment was not best as a result (except of the case when it could not provide the service because it had been switched manually to independent operation), an assignment teacher signal better than the assignment by means of the fuzzy group supervisory control can be obtained, by creating an output pattern in which the assignment fitness of the elevator which has actually provided the service is maximized.

Then, in Step S17, the input pattern and the output pattern, i.e. the teacher signal, are paired and stored as the learning sample. The above-mentioned procedure is repeatedly executed through Step S18 until a predetermined number of learning samples are collected and, using the collected learning samples, the initial learning of the neural net is implemented in Step S19.

That is, the input pattern of the learning sample is input to the neural net as described before, the error between the output pattern at that time and the output pattern which is the teacher signal is found and the values of the connection weights are modified successively from the output layer by using the error. Repeating this process, the initial learning is finished when the value of the connection weight converges. It then becomes possible to assign in the same level with the teacher signal even for unknown input patterns.

If the state of the elevator system at the moment when a hall call is made is considered as a "question", the most suitable elevator to be assigned at that time is, so to speak, in a relation of "answer". When the mechanism of the operation of the neural net is compared with the operation of the human brain, the method of learning by the learning sample in which the elevator group data and the assigned elevator are paired as described above resembles making people learn just by presenting a question and an answer. This method therefore has a problem that it is difficult to understand the process for reaching to the answer and it not only takes a great amount of time to learn but also has a risk of learning how to give an answer with a trivial interpretation. That is, if the result of assignment of the fuzzy group supervisory control is taken as the input signal of the neural net as described above, part of the input data often coincides with the teacher signal and the neural net may possibly learn to merely pass the input to the output in the stage of the initial learning.

In order to avoid such a problem, the initial learning of the neural net is divided into two stages of "preliminary learning" and "objective learning".

The "preliminary learning" is a learning for acquiring a wide knowledge concerning to the group supervisory control and data which exerts a great influence on the judgment of assignment and which provides an accurate measured value, such as a hall call waiting time, is adopted as the teacher signal.

In the "objective learning", the neural net having the knowledge obtained in the preliminary learning learns the judgment of assignment of AI group supervisory control. That is, when the neural net is made to perform the preliminary learning adopting the waiting time as the teacher signal in the first stage and to perform the objective learning adopting the assigned elevator as the teacher signal in the second stage, it becomes possible to avoid the neural net from learning to just pass the input to the output as it is.

In the preliminary learning, however, although it is easy to obtain the waiting time (time necessary for arrival) of the elevator arriving first in response to a hall call as the teacher signal when the learning is performed by adopting the waiting time as the teacher signal, it is difficult to obtain waiting times of other elevators as the teacher signals. For the other elevators, although it is conceivable to use times when they arrive at the hall or times when they pass through there as the teacher signals, the operation of the elevators with respect to that hall changes depending on whether the hall call has been allocated or not. In particular, they will differ from expected values significantly when cars are reversed at intermediate floors or become empty and stop. That is, the waiting time (time necessary for arrival) for that hall call cannot be known correctly for the elevators to which that hall call has not been allocated. Accordingly, if the waiting times of all elevators are supplied as teacher signals in one learning sample in implementing learning by adopting the waiting time as the teacher signal in the neural net as shown in FIG. 2, there is a risk of causing the neural net to learn less meaningful data except for the waiting time of the elevator arriving first, posing a problem that not only the learning efficiency is worsened, but also the accuracy of prediction drops.

This problem can be solved by implementing the learning by using a learning sample created by converting the elevator group data into the input pattern and only adopting the waiting time of the assigned elevator (elevator arriving first) as the teacher signal. At this time, in the output layer, only the connection weight connected to the neuron to which the teacher signal is supplied is modified, based on the error between the teacher signal and the output, and the value after the modification is reflected to connection weights connected to other neurons in the output layer, located at symmetrical positions from that connection weight.

This operation will be explained with reference to a neural net shown in FIG. 6.

Similar to one in FIG. 2, the neural net consists of three layers of an input layer (first layer), a middle layer (second layer) and an output layer (third layer) and is illustrated exemplifying a case when the number of elevators is three.

Figure 7:
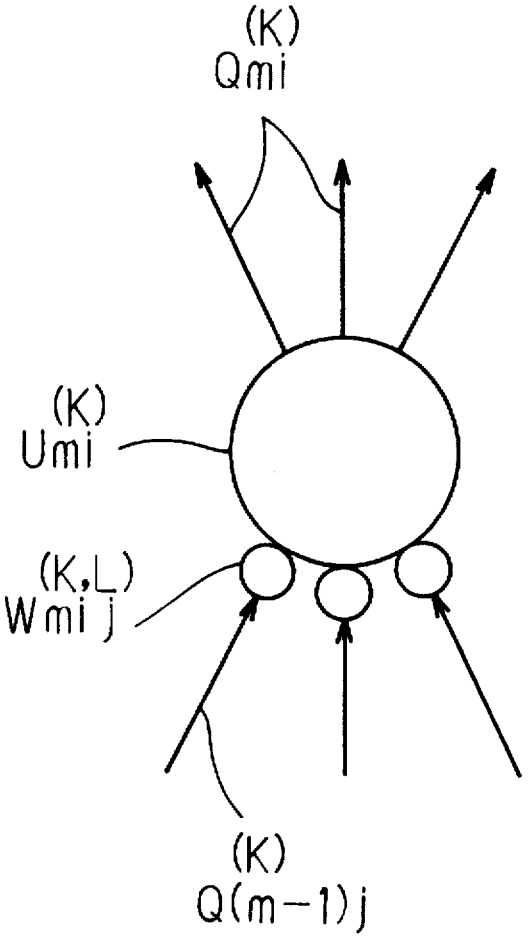
FIG. 7 is a diagram illustrating a structure of a neuron.

FIG. 7 shows the structure of each neuron.

Figure 6:
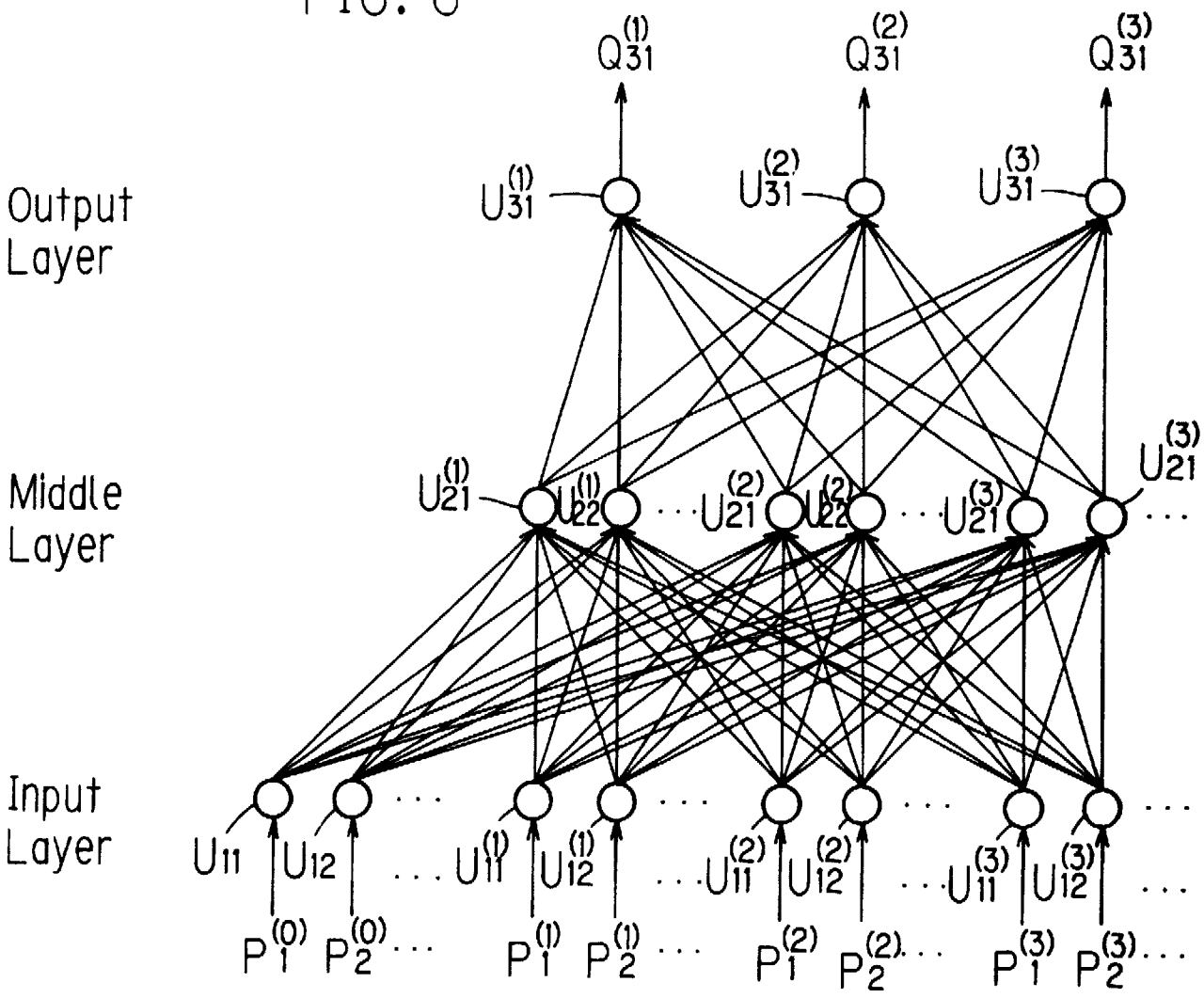
FIG. 6 is a diagram showing one example of the neural net in which waiting times are output patterns.

In FIGS. 6 and 7, $Umi^{(K)}$ represents an i-th neuron in the m-th layer of the elevator No. K, $Qmi^{(K)}$ represents the output from the i-th neuron in the m-th layer of the elevator No. K, $Pi^{(K)}$ represents an i-th input data of the elevator No. K (i-th input data concerning the entire $Pi^{(O)}$ group) and $Wmij^{(K,L)}$ represents a connection weight between the i-th neuron in the m-th layer of the elevator No. K and a j-th neuron in a m−1th layer of an elevator No. L, respectively.

Figure 8:
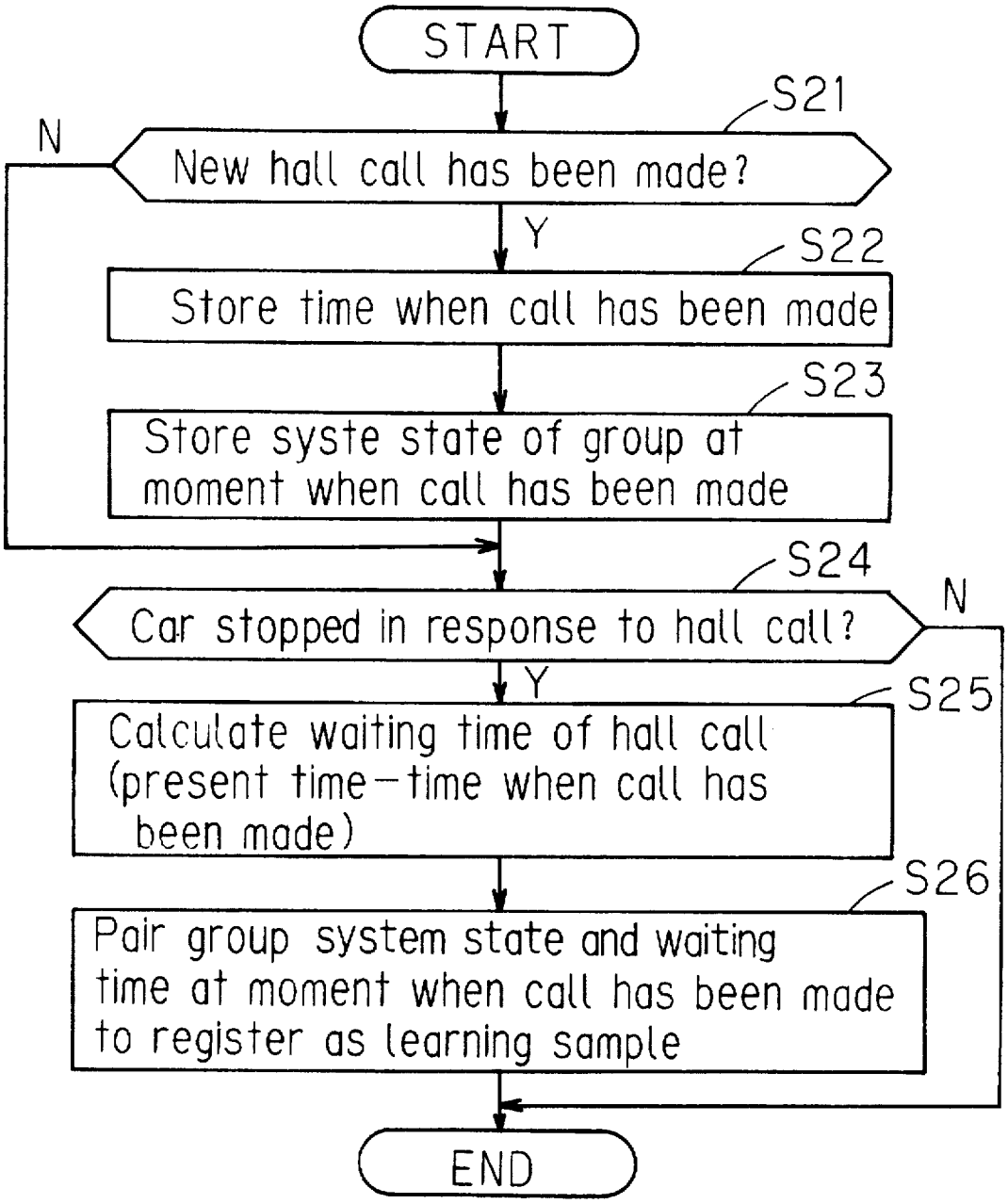
FIG. 8 is a flowchart showing a procedure for creating a learning sample in which a waiting time is adopted as a teacher signal.

FIG. 8 is a flowchart showing a procedure for creating the learning sample. It is determined first in Step S21 whether a new hall call has been made or not. When the call has been made, the time when the call has been made is stored in Step S22 and group data at the moment when the call has been made is stored in Step S23.

Then, when it is confirmed that the car has stopped in response to the call in Step S24, a difference between the present time and the time when the call has been made is taken to calculate an actual waiting time of the hall call in Step S25. Then, the group data at the moment when the call has been made and the actual waiting time are paired and registered as the learning sample in Step S26. Thus, a large number of learning samples, in which only the waiting time of the assigned elevator (elevator arriving first) is adopted as the teacher signal, are registered by repeating the above-mentioned procedure every time when a hall call is made.

Figure 9:
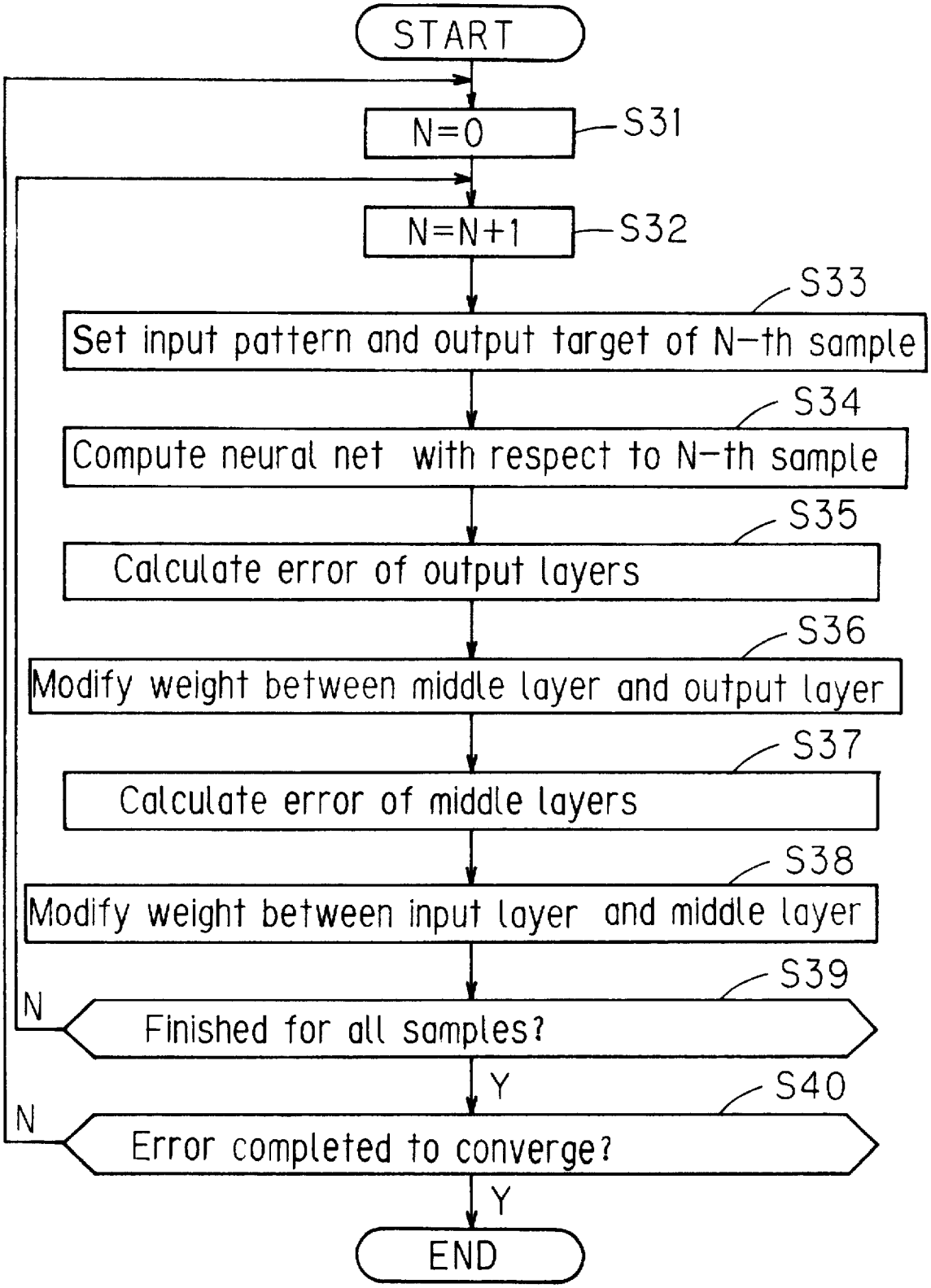
FIG. 9 is a flowchart showing a procedure for learning by using the learning sample.

FIG. 9 is a flowchart showing a procedure for learning by using those learning samples. First, a variable N which represents the sample No. is initialized to zero in Step S31 and the value of N is incremented to N+1 in Step S32. The input pattern and an output target of the N-th learning sample are set in Step S33 and the arithmetic operation of each layer, in an order starting from the input layer of the neural net, is carried out for the N-th sample in Step S34.

Then, an error between the output of the output layer and the output target is calculated in Step S35 and the connection weight between the middle layer and the output layer is modified based on that error in Step S36.

If the elevator No. 2 is the assigned elevator (elevator arriving first) in the N-th learning sample in Step S34 for example, the teacher signal is supplied only to the output layer of the elevator No. 2, so that only an error between $Q_{31}^{(2)}$ which is an output from the neuron in the output layer (third layer) of the elevator No. 2 and the teacher signal is calculated in Step S35 and a connection weight connected to $U_{31}^{(2)}$, which is the neuron in the output layer of the elevator No. 2, is modified successively based on the error in Step S36.

At this time, because elevator systems are symmetrical with respect to interchange of elevators in general, the modified result of the elevator No. 2 may be used as it is in modifying the connection weight connected to neuron $U_{31}^{(1)}$ in the output layer of the elevator No. 1 and the connection weight connected to neuron $U_{31}^{(3)}$ in the output layer of the elevator No. 3. For example, $W_{311}^{(1,1)}$, $W_{311}^{(3,3)}$ and $W_{311}^{(2,2)}$ which are located at symmetrical positions, respectively, may have the same value and $W_{311}^{(1,2)}$, $W_{311}^{(1,3)}$, $W_{311}^{(2,1)}$, $W_{311}^{(2,3)}$, $W_{311}^{(3,1)}$ and $W_{311}^{(3,2)}$ may also have the same value.

It is noted that while each connection weight at the symmetrical position may be made to have the same value by copying the result of modification every time when the modification is made based on the error, the modification of one connection weight may be reflected immediately to other equivalent connection weights, thus simply and efficiently carrying out the modification, by using a programming technique whereby those connection weights which must have the same value, are stored at the same address of memory.

Next, in Step S37, an error is calculated for each neuron in the middle layer, this time based on the weight modification result in Step S36; and based on the error, each connection weight between the input layer and the middle layer is modified successively in Step S38.

When it is confirmed that the above-mentioned procedures repeated for all samples have been finished in Step S39, the procedure Step S31 through Step S40 is repeated again until the error converges via Step S40. The preliminary learning is finished when the error fully converges.

After finishing the preliminary learning in that way, the objective learning is performed this time with the same procedure by adopting the assigned elevator as the teacher signal. The procedure of the objective learning is the same as the flowchart shown in FIG. 5 and an explanation thereof is omitted here. The initial learning is completed when the objective learning is finished.

By the way, while the most suitable elevator to be assigned at that time may be considered as an "answer" if the state of the elevator system at the moment when the hall call has been made is considered as a "question" as described before, the predicted waiting time (time necessary to respond) of each elevator to the hall call may be considered to be, so to speak, corresponding to a "hint". Accordingly, learning the waiting time at first and then learning the assigned elevator resembles learning how to create a hint (a process for reaching an answer) with respect to a question at first and then learning how to derive the answer later, when we compare it with the operation of the human brain. Accordingly, this method has a problem that it has a risk of attaching importance to the process rather than to finding a correct answer, and that it requires a significant amount of learning time because of the two-step learning. Because it is considered to be apparently efficient to learn both the hint and the answer to the question in the same time in the human brain, as compared to the above-mentioned method, it is expected to lead to the improvement of the learning efficiency and assignment capability similarly also in the neural net to learn the waiting time and the assigned elevator in the same time.

To that end, a preferable neural net for call allocation of the present invention is provided with an output layer which corresponds to a predicted waiting time of hall call, besides the output layer which corresponds to the assigned elevator. That is, the neural net outputting the predicted waiting time and the neural net outputting the assigned elevator are merged and the input layer and the middle layer are made common. The learning of this neural net constructed as described above is implemented by supplying the teacher signal of the assigned elevator and a teacher signal of the predicted waiting time to the same input pattern in the same time.

Figure 10:
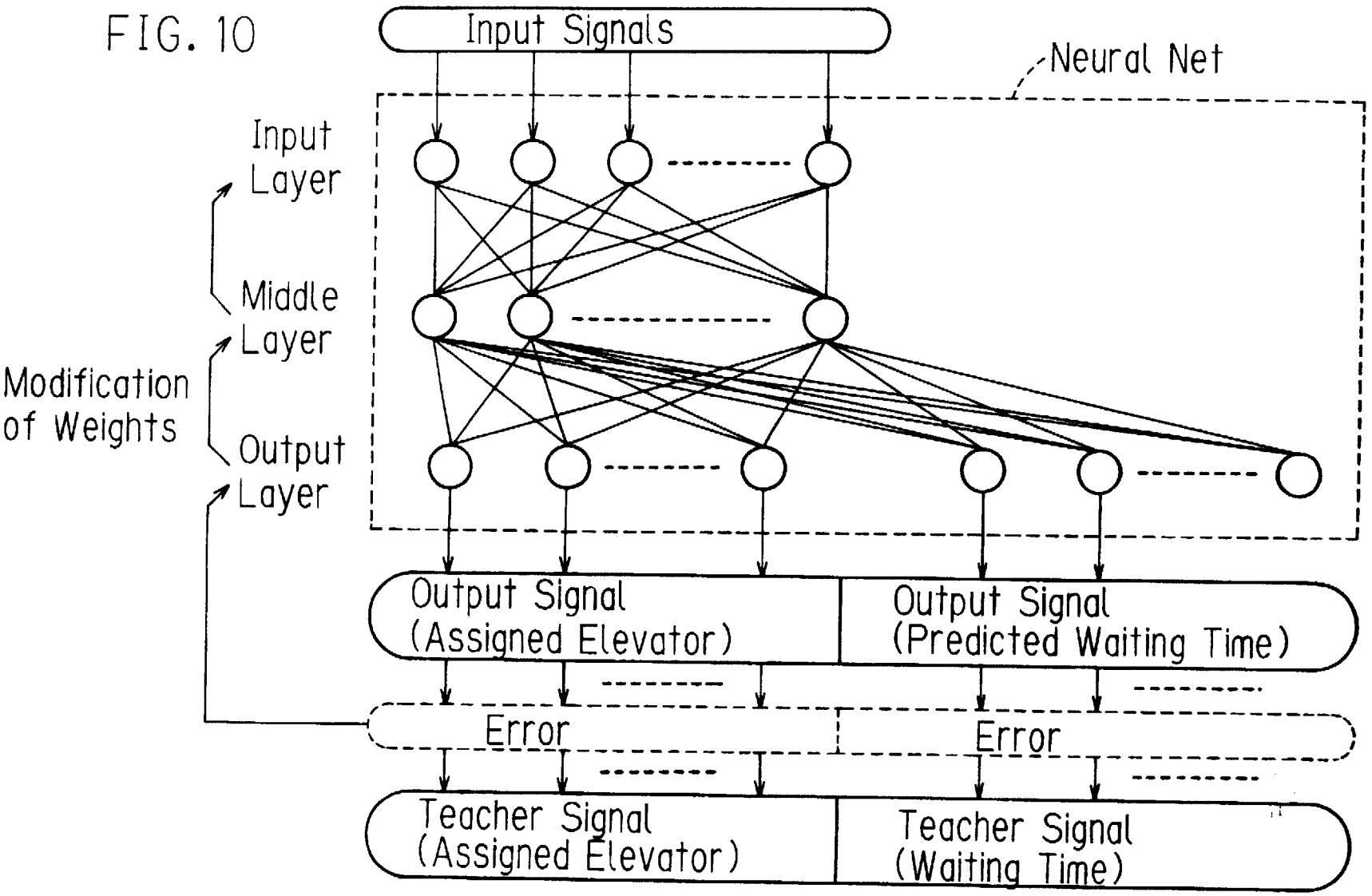
FIG. 10 is a diagram illustrating one example of a structure of the neural net when the both assigned elevator and waiting time are adopted as teacher signals.

FIG. 10 shows a connection of the neural net in this case. As it is apparent from the figure, there is an output layer which corresponds to the hall call predicted waiting time, besides the output layer which corresponds to the assigned elevator (assignment fitness), as the output layer, so as to be able to implement the learning by supplying the teacher signals of the assigned elevator and the waiting time to the same input pattern in the same time.

It is noted that while it is necessary to create a large number of learning samples in which the assigned elevator is adopted as the teacher signal and in which the waiting time is adopted as the teacher signal in advance in implementing the learning, the learning samples for call allocation can be created with the same procedure with the aforementioned flowchart shown in FIG. 5. Further, the learning samples for the waiting time may be created with the same procedure in the afore-mentioned flowchart shown in FIG. 8.

It is also noted that because the teacher signal of the assigned elevator and the teacher signal of the waiting time are supplied simultaneously in learning in the present embodiment, one set of the learning samples for call allocation and for waiting time for the same input pattern may be considered as one learning sample; or a learning sample in which the assigned elevator and the waiting time are adopted as the teacher signals, respectively, for the same input pattern may be created from the beginning.

When a number of the learning samples thus created exceeds a predetermined number, the learning is implemented with exactly the same procedure like the flowchart shown in FIG. 9.

By doing so, the preliminary learning and the objective learning described above can be implemented simultaneously, allowing the improvement of learning efficiency and the improvement of the assignment capability.

When the initial learning is thus finished, the neural net can assign in the same level with the teacher signal even to an unknown input pattern and the call allocation can be performed with this neural net thereafter.

Figure 11:
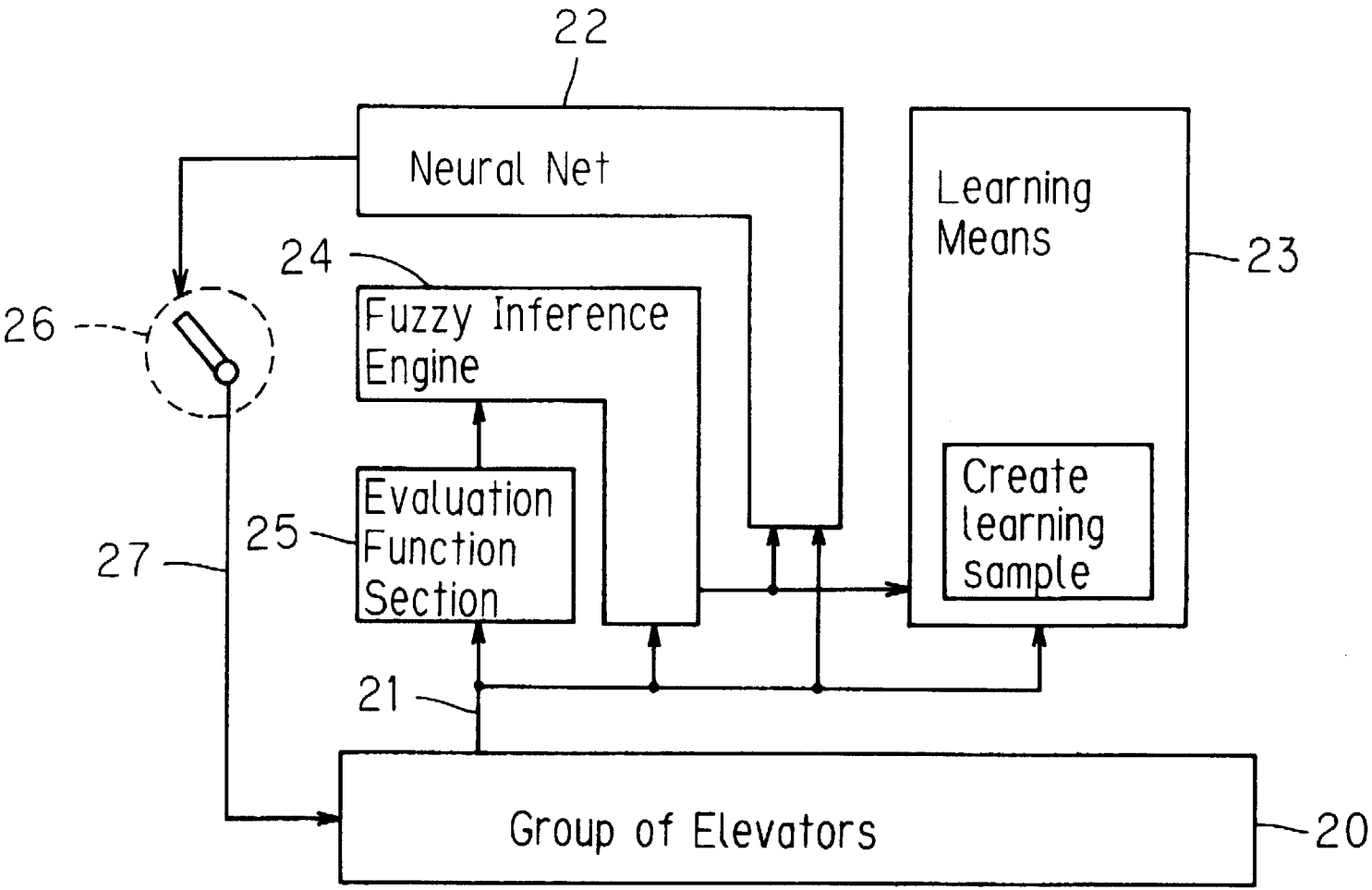
FIG. 11 is a block diagram illustrating a structure when an assignment is made by using the neural net after completing the initial learning.

FIG. 11 shows a system structure where the assignment is performed using the neural net after completing the initial learning.

As shown in the figure, when a new hall call is made, group data 21 of elevators at that moment is input to the evaluation function section 25 and the fuzzy inference engine 24 and data of result of temporary assignment thereof is input to the neural net 22 together with other group data. Because the neural net 22 has already finished the initial learning as described above, it is equipped with the assignment capability in the same level with the teacher signal. The switching means 26 is switched to assignment by means of the neural net. Accordingly, the assignment signal 27 from the neural net is output to the group of elevators 20, which is controlled thereafter by the assignment signal from the neural net 22.

While the preferred embodiment of the present invention has been described, such description is for illustrative purposes only and should not be construed as limiting the invention described in the appended claims or reducing the scope thereof. Further, the structure of each part of the present invention is not confined only to the embodiment described above. Rather, variations thereto will occur to those skilled in the art within the scope of the present inventive concepts which are delineated by the following claims.

What is claimed is:

1. An elevator group supervisory control system for providing service of a plurality of elevators to a plurality of floors by selecting the most suitable car among them, when a hall call is made, to assign to the hall call, comprising:

temporary assigning means for performing a first step assignment operation producing first step data indicating an optimal elevator based on group data indicating various states of said elevators when the hall call is made;

a neural net for receiving input patterns in which the first step data of said first step assignment of said temporary assigning means is converted into numerical values together with other group data and outputting an assignment fitness for each of said elevators as an output pattern which indicates a selected one of said elevators to be assigned to said hall call; and assigning means for assigning the selected one of the elevators at a second step based on the output pattern of said neural net.

2. An elevator group supervisory control system for providing service of a plurality of elevators to a plurality of floors by selecting the most suitable car among them, when a hall call is made, to assign to the hall call, comprising:

temporary assigning means for temporarily assigning the car based on group data indicating various states of said elevators when the hall call is made;

a neural net for receiving input patterns in which the result of assignment of said temporary assigning means is converted into numerical values together with other group data and outputting an assignment fitness as an output pattern;

assigning means for deciding the elevator to be assigned from the output pattern of said neural net;

learning means for implementing an initial learning of said neural net; and switching means for switching between the assignment by means of said temporary assigning means during the initial learning and the assignment by means of said neural net after completion of the initial learning.

3. The elevator group supervisory control system according to claim 2, wherein the assignment made by said temporary assigning means is an assignment made by means of a fuzzy group supervisory control.

4. The elevator group supervisory control system according to claim 2, wherein the initial learning of said neural net consists of a preliminary learning in which the waiting time of a hall call is adopted as a teacher signal and an objective learning in which the assigned elevator is adopted as a teacher signal.

5. The elevator group supervisory control system according to claim 4, wherein learning samples, in which only a waiting time of the assigned elevator is adopted as the teacher signal, are used in the preliminary learning and a connection weight, connected to the neuron to which the teacher signal is supplied, is modified in the output layer of the neural net to reflect the value after the modification to connection weights connected to other neurons at symmetrical positions.

6. The elevator group supervisory control system according to claim 4, wherein said neural net is constructed so that the input layer and a middle layer are common and an output layer which corresponds to the assigned elevator and an output layer which corresponds to the waiting time of the hall call are separately provided to implement the preliminary learning and the objective learning simultaneously.

7. The elevator group supervisory control system according to claim 1, wherein the first-step assignments made by said temporary assigning means, is performed by an artificial intelligence-based group control.

8. The elevator group supervisory control system according to claim 7, wherein said artificial intelligence-based group control is a fuzzy group control.

* * * * *